US005407268A

United States Patent [19]

Henrich

[11] Patent Number: 5,407,268

[45] Date of Patent: Apr. 18, 1995

[54] KNEADER FOR THE TREATMENT OF FIBROUS PULP SUSPENSIONS

[75] Inventor: Hans Henrich, Heidenheim, Germany

[73] Assignee: J.M. Voith GmbH, Heidenheim, Germany

[21] Appl. No.: 293,747

[22] Filed: Aug. 22, 1994

Related U.S. Application Data

[63] Continuation of Ser. No. 147,951, Nov. 4, 1993, abandoned.

[30] Foreign Application Priority Data

Nov. 6, 1992 [DE] Germany ..... 42 37 433.2

[51] Int. Cl.[6] ..... B01F 15/02; D21C 7/14

[52] U.S. Cl. ..... 366/156.1; 366/184; 366/194; 366/321; 162/243

[58] Field of Search ..... 366/76, 77, 83, 86, 366/91, 156, 186, 194–196, 290, 292, 303, 307, 321; 425/204, 205, 209; 162/57, 243

[56] References Cited

U.S. PATENT DOCUMENTS

| | | | |
|---|---|---|---|
| 1,827,710 | 10/1931 | Leyst-Kuchenmeister | 162/57 X |
| 2,377,069 | 5/1945 | Brubaker | 366/290 X |
| 3,575,791 | 4/1971 | Messing | 162/243 X |
| 3,702,691 | 11/1972 | Fritsch | 366/298 X |
| 3,861,287 | 1/1975 | Manser | 366/83 X |
| 3,869,111 | 3/1975 | Matsuoka | 366/83 X |
| 3,977,658 | 8/1976 | Wittrock et al. | 366/86 |
| 4,214,862 | 7/1980 | Kolossow | 425/204 |
| 4,295,925 | 10/1981 | Bentvelzen et al. | 162/57 X |
| 4,797,080 | 1/1989 | Wanninger | 425/205 X |

FOREIGN PATENT DOCUMENTS

| | | | |
|---|---|---|---|
| 24728 | 7/1951 | Finland | 162/243 |
| 426006 | 10/1974 | U.S.S.R. | 162/243 |

OTHER PUBLICATIONS

Burns et al., "Waste Paper Preparation Plant and Systems", Paper Technology, Jun./Aug. 1973, pp. 196–203.

*Primary Examiner*—David A. Scherbel
*Assistant Examiner*—Charles Cooley
*Attorney, Agent, or Firm*—Baker & Daniels

[57] ABSTRACT

A substance kneader, specifically for cellulose fiber suspensions, with kneading elements arranged at the periphery of a rotor encased in a housing. Two drum type rotor parts and a rotor part disposed in between feature a feed worm conveyor for each rotor part. In the area between facing ends of the worm conveyors, and symmetric to this area, are the inlet openings of the housing. On the ends away from each other, of the rotor parts, are the outlet openings of the housing. The outlet openings are each coordinated with delivery worm conveyors having variable-RPM drive for control of throughput and/or dwell time of the substance to be kneaded.

15 Claims, 2 Drawing Sheets

KNEADER FOR THE TREATMENT OF FIBROUS PULP SUSPENSIONS

This is a continuation of application Ser. No. 08/147,951, filed Nov. 4, 1993, now abandoned.

BACKGROUND OF THE INVENTION

The invention concerns a substance kneader, specifically for cellulose fiber suspensions. Such a kneader is known from Paper Technology, July, 1973, pages 196 through 202, respectively, T 136 through T 142.

Such machines process fiber materials at consistencies between generally 26 to 35% and at an elevated temperature generated by a steam supply. A worm conveyor is provided, which feeds the substance to the kneader, and a compression worm immediately precedes the kneading elements of the rotor. Concerned here are machines having a housing which on one end features an inlet, and on the opposite end features an outlet.

When treating the substance, generally referred to as fiber suspension, rather high pressures are required so that relatively high axial forces occur on the rotor and, thus, on their bearings. Of course, the treatment must be such that all fiber ingredients will be affected at maximum uniformity. Also required is an appropriately long treatment time, which amounts to approximately 20 s.

With machines of prior design, the treatment time for the individual fibers of a charge was essentially the same. At very high throughputs, however, appreciable difficulties arose in the design of the machine.

The problem underlying the invention is to provide a kneader which enables high amounts of throughput also at very high treatment pressures.

SUMMARY OF THE INVENTION

This problem is solved through the features of the present invention.

A substance kneader, specifically for cellulose fiber suspensions, has kneading elements arranged at the periphery of a rotor encased in a housing. Two drum type rotor parts have a rotor part disposed in between featuring a feed worm conveyor for each drum type rotor part. In the area of the mutually facing ends of the feed worm conveyors, and symmetrical to this area, is an inlet opening of the housing. At the opposite ends of the rotor parts are outlet openings of the housing, with delivery worm conveyors coordinated with each of the outlet openings.

An exact setting of throughput amounts or, specifically, of the treatment time of the fibers can be accomplished through the delivery worm conveyors. The essentially symmetrical design of the machine makes bearing loads resulting from the axial forces of the rotor very insignificant. As a result, all fibers will be subjected to essentially the same specific expense of effort.

BRIEF DESCRIPTION OF THE DRAWINGS

The invention will be illustrated hereafter with the aid of the drawing figures.

DETAILED DESCRIPTION OF THE INVENTION

Figure 2:
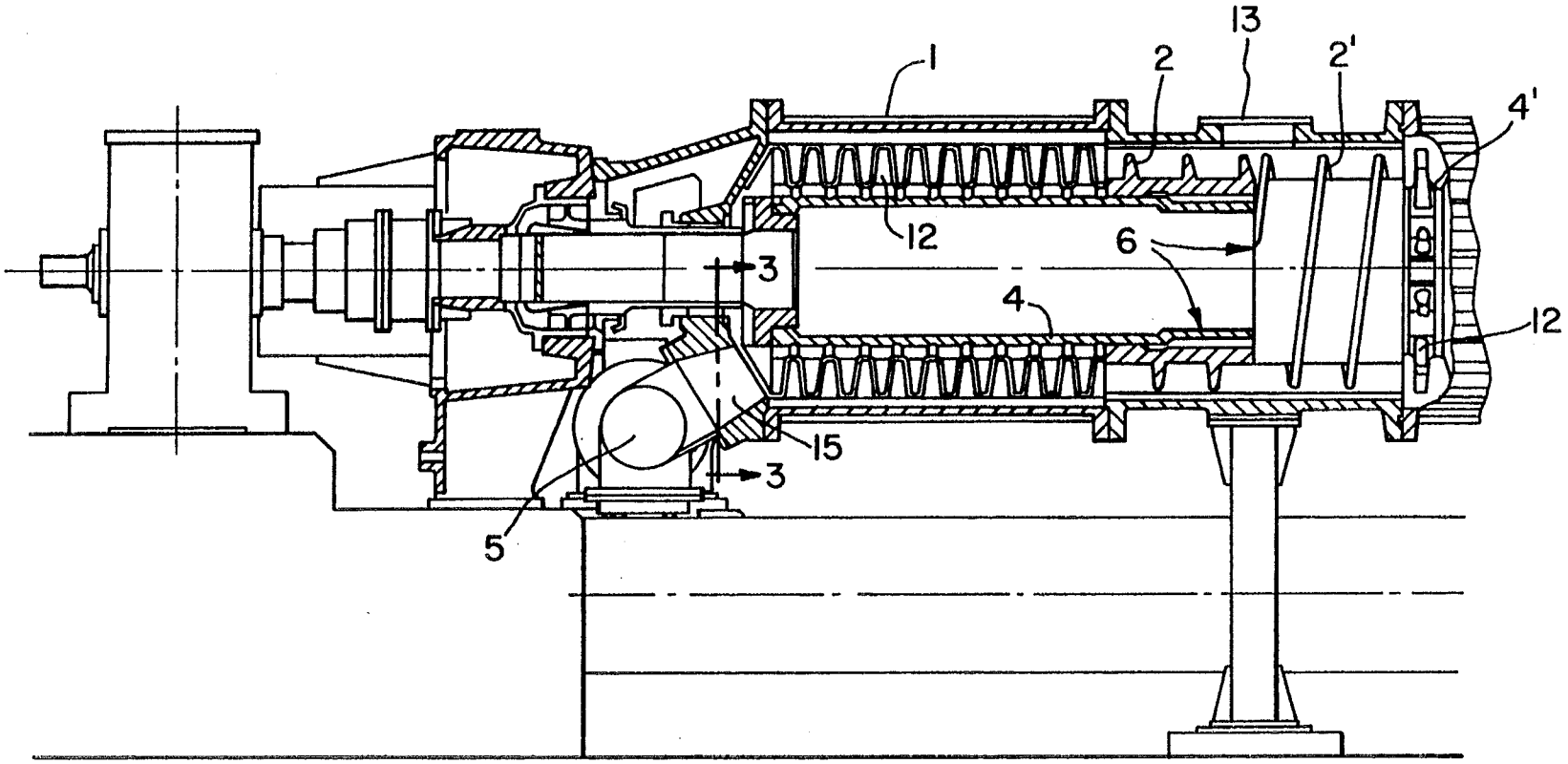
FIG. 2 shows a partial axial section through the kneader.

Arranged centrally, or concentrically, in the housing 1 is a rotor consisting of rotor parts 4, 4' and 6, with the rotor parts 4 and 4' supporting the kneading elements 12 which extend radially outwardly from rotor parts 4, 4' as seen in FIG. 2. The rotor part 6 essentially features a feed worm conveyor 2, 2' for each of the rotor parts 4 and 4' respectively. The inlet opening 8 is arranged symmetrical to the feed worm conveyor region contained between the rotor parts 4 and 4' and it is preceded by a feed auger 10.

Figure 1:
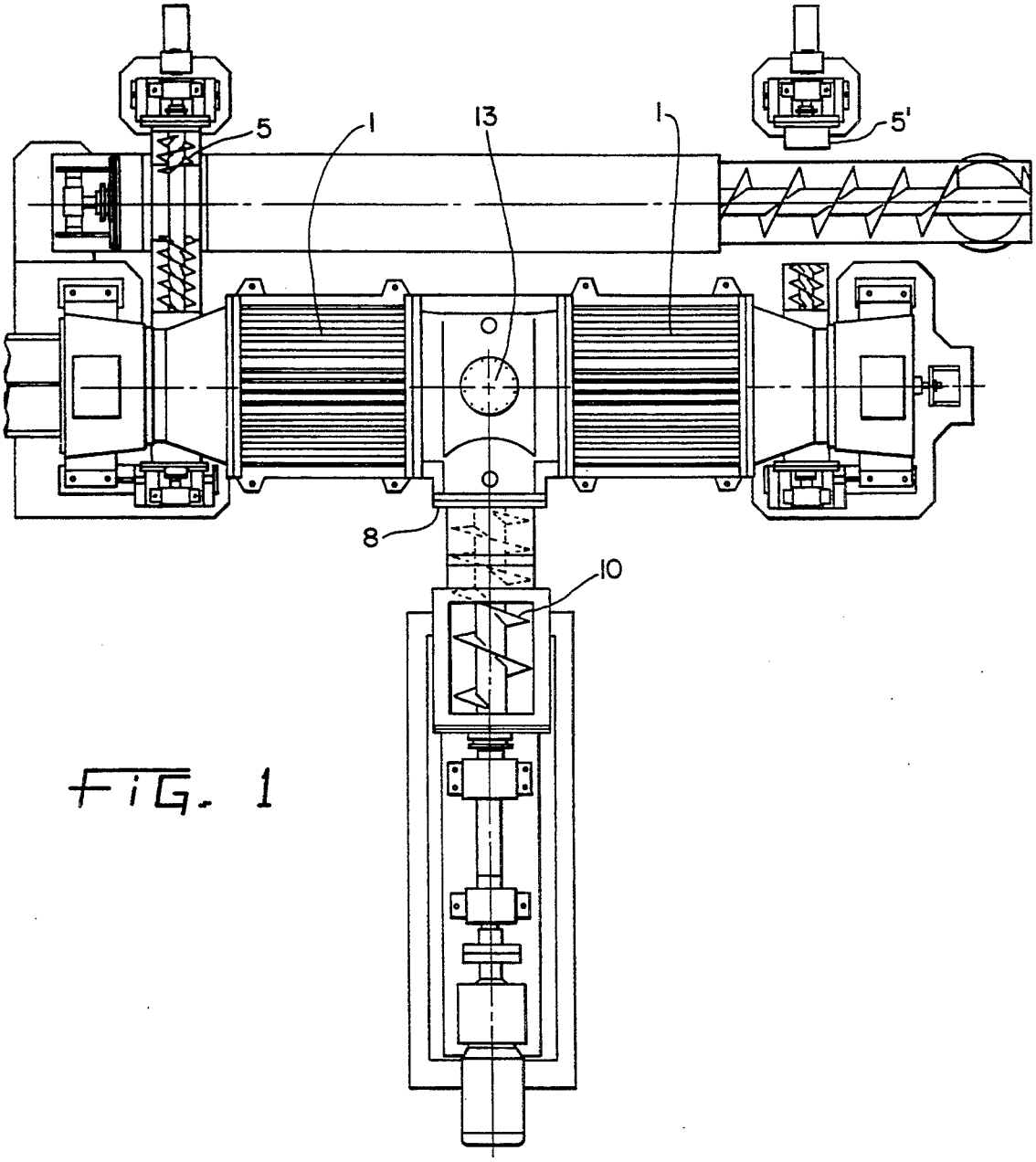
FIG. 1 shows a plan view of the inventional kneader, partly in section.
Figure 3:
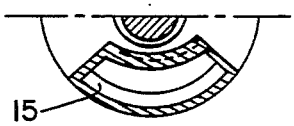
FIG. 3 shows a cross section taken along line III—III of FIG. 2.

The feed worm conveyors 2 and 2' effect a respective compression of the fiber suspension, in order to be able to maintain the respective pressure in the housing. Also contained in this housing region is a closable opening 13 for the supply of steam and chemicals. FIG. 3 shows a cross section of the substance kneader illustrating delivery opening 15, in the form of an arc-shaped sector. In this region, a delivery worm conveyor 5 and 5', respectively, each extends transverse to the axis of rotation of the rotor. The delivery worm conveyors may each include a variable-RPM drive for control of throughput and/or dwell time of the substance to be kneaded.

The time of fiber passage through the housing is essentially controlled by regulating the speed of rotation of these worm conveyors. Resulting thereof is a control of the level of compression and power consumption in both kneading spaces. The delivery worm conveyors, of course, run essentially in synchronism.

Additionally, the following is achieved through the feed worm conveyor: a fiber suspension plug of rather high consistency (as stated above) is created, enabling the two feed worm conveyors 2 and 2' to then distribute the entire throughput evenly to the two rotor parts 4 and 4' respectively, and the corresponding kneading spaces.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A stock kneader for the treatment of fiber suspensions, comprising:

a housing, said housing having an inlet opening;

a kneading rotor encased within said housing, said kneading rotor having two symmetric sections, each of said sections having a generally equal length, each of said sections having an outer periphery and having kneading elements at said periphery said kneading elements extending radially outwardly from the outer periphery of each of said sections, said sections having a juncture therebetween, each of said sections further having an exit end;

said housing and said kneading rotor defining a kneading space;

a feed auger communicating with said kneading space at said juncture, said feed auger being structured and arranged to empty fiber suspension into said inlet opening;

each of said two symmetric sections including a feed worm conveyor proximate said juncture, each of said feed worm conveyors being structured for operation in counterflow such that said emptied fiber suspension is split into two flows and passed to the kneading elements; and a delivery worm conveyor connected to said exit end of each of said kneading rotor symmetric sections, each of the delivery worm conveyors including a variable-RPM drive for control of throughput of the fiber suspension to be kneaded.

2. Kneader according to claim 1, wherein the housing has a lower area, and wherein outlet openings are positioned in said lower area.

3. Kneader according to claim 2, wherein the outlet openings are fashioned as arc-shaped sectors.

4. Kneader according to claim 1, wherein said rotor has an axis of rotation, and wherein the delivery worm conveyors are arranged transverse to the axis of rotation of the rotor.

5. Kneader according to claim 1, wherein said rotor has an axis of rotation, and wherein said feed auger is positioned transverse to the axis of rotation of the rotor.

6. A stock kneader for the treatment of fiber suspensions, comprising:

a housing, said housing having an inlet opening;

a kneading rotor encased within said housing, said kneading rotor having two symmetric sections, each of said sections having a generally equal length, each of said sections having an outer periphery and having kneading elements at said periphery said kneading elements extending radially outwardly from the outer periphery of each of said sections, said sections having a juncture therebetween, each of said sections further having an exit end;

said housing and said kneading rotor defining a kneading space;

a feed auger communicating with said kneading space at said juncture, said feed auger being structured and arranged to empty fiber suspension into said inlet opening;

each of said two symmetric sections including a feed worm conveyor proximate said juncture, each of said feed worm conveyors being structured for operation in counterflow such that said emptied fiber suspension is split into two flows and passed to the kneading elements; and a delivery worm conveyor connected to said exit end of each of said kneading rotor symmetric sections, each of the delivery worm conveyors including a variable-RPM drive for control of dwell time of the fiber suspension to be kneaded.

7. Kneader according to claim 6, wherein the housing has a lower area, and wherein outlet openings are positioned in said lower area.

8. Kneader according to claim 7, wherein the outlet openings are fashioned as arc-shaped sectors.

9. Kneader according to claim 6, wherein said rotor has an axis of rotation, and wherein the delivery worm conveyors are arranged transverse to the axis of rotation of the rotor.

10. Kneader according to claim 6, wherein said rotor has an axis of rotation, and wherein said feed auger is positioned transverse to the axis of rotation of the rotor.

11. A stock kneader for the treatment of fiber suspensions, comprising:

a housing, said housing having an inlet opening;

a kneading rotor encased within said housing, said kneading rotor having two symmetric sections, each of said sections having a generally equal length, each of said sections having an outer periphery and having kneading elements at said periphery said kneading elements extending radially outwardly from the outer periphery of each of said sections, said sections having a juncture therebetween, each of said sections further having an exit end;

said housing and said kneading rotor defining a kneading space;

a feed auger communicating with said kneading space at said juncture, said feed auger being structured and arranged to empty fiber suspension into said inlet opening;

each of said two symmetric sections including a feed worm conveyor proximate said juncture, each of said feed worm conveyors being structured for operation in counterflow such that said emptied fiber suspension is split into two flows and passed to the kneading elements; and a delivery worm conveyor connected to said exit end of each of said kneading rotor symmetric sections, each of the delivery worm conveyors including a variable-RPM drive for control of throughput and dwell time of the fiber suspension to be kneaded.

12. Kneader according to claim 11, wherein the housing has a lower area, and wherein outlet openings are positioned in said lower area.

13. Kneader according to claim 12, wherein the outlet openings are fashioned as arc-shaped sectors.

14. Kneader according to claim 11, wherein said rotor has an axis of rotation, and wherein the delivery worm conveyors are arranged transverse to the axis of rotation of the rotor.

15. Kneader according to claim 11, wherein said rotor has an axis of rotation, and wherein said feed auger is positioned transverse to the axis of rotation of the rotor.

* * * * *